US006457414B1

(12) United States Patent
Kato et al.

(10) Patent No.: US 6,457,414 B1
(45) Date of Patent: Oct. 1, 2002

(54) PRINTING PLATE DISCHARGING METHOD AND PRINTING PLATE DISCHARGING DEVICE

(75) Inventors: Takashi Kato, Saitama (JP); Mamoru Murata, Saitama (JP); Yoshinori Kawamura, Kanagawa (JP); Takashi Koizumi, Kanagawa (JP)

(73) Assignees: Fuji Photo Film Co., Ltd., Kanagawa (JP); Fuji Photo Optical Co., Ltd., Saitama (JP)

( * ) Notice: Subject to any disclaimer, the term of this patent is extended or adjusted under 35 U.S.C. 154(b) by 0 days.

(21) Appl. No.: 09/664,406

(22) Filed: Sep. 18, 2000

(30) Foreign Application Priority Data

Sep. 17, 1999 (JP) ..... 11-264088

(51) Int. Cl.[7] ..... B41L 47/14
(52) U.S. Cl. ..... 101/477; 101/463.1
(58) Field of Search ..... 101/477, 463.1, 101/494, 467; 355/99, 100, 72, 73; 414/20

(56) References Cited

U.S. PATENT DOCUMENTS 4,006,984 A * 2/1977 Friese ..... 355/73
4,389,156 A * 6/1983 Dennhardt et al. ..... 101/477

* cited by examiner

*Primary Examiner*—Leslie J. Evanisko
(74) *Attorney, Agent, or Firm*—Sughrue Mion, PLLC

(57) ABSTRACT

A printing plate discharging method and a printing plate discharging device can quickly and reliably discharge a printing plate from a surface plate, which printing plate has been placed in a state wherein one end portion of the printing plate projects from the surface plate, without making an exposed face of the printing plate dirty or scratched. At a discharging mechanism section of an automatic exposure device, a temporary support arm corresponds with the one end portion of the printing plate, which end portion projects from on the surface plate. The temporary support arm is raised higher than the surface plate by a moving stage moving and a roller thereby abutting against a projecting portion of the temporary support arm. Thus, the temporary support arm lifts up the one end portion of the printing plate. In this state, a plate discharging hook engages the one end portion of the printing plate (a lifted portion) and pushes the printing plate toward another end portion of the surface plate. Thus, the printing plate can be discharged from the surface plate.

32 Claims, 12 Drawing Sheets

PRINTING PLATE DISCHARGING METHOD AND PRINTING PLATE DISCHARGING DEVICE

BACKGROUND OF THE INVENTION

1 Field of the Invention

The present invention relates to a printing plate discharging method and printing plate discharging device for discharging a printing plate that is laid on a surface plate from the surface plate such as an exposure stage.

2 Description of the Related Art

Technology for printing plate automatic exposure devices has been developed whereby an image is recorded onto a printing plate. The printing plate (e.g. a PS plate, a thermal plate, a photopolymer plate, and the like) is provided with a recording layer on top of a base layer. The image is recorded at the printing plate's recording layer with a direct laser beam or the like.

In this sort of technology, a plurality of printing plates are stored in a stacked state in a magazine beforehand. The printing plates are automatically taken one at a time and fed into an exposure section. At the exposure section, the printing plate that has been fed is placed on a surface plate in a state wherein one end of the printing plate is projecting, such that a puncher can punch holes for positioning at the end portion of the printing plate. The printing plate, which has been placed on the surface plate in the state wherein one end of the printing plate is projecting, is scanned and exposed by a scanning device under the same state. After the image has been exposed, the printing plate is discharged from the surface plate and sent to a developing device for a next process.

Images can be recorded onto printing plates quickly. Therefore, it is important that a printing plate that has been exposed on the surface plate is quickly and reliably discharged from the surface plate and fed to the next process. Conventionally, an exposed printing plate is discharged from the surface plate and fed to the next process by a plurality of transport rollers.

However, in this conventional discharging method of discharging the printing plate by means of transport rollers, a plate face of the printing plate (an exposed face) can easily become dirty or be scratched. Further, a transport mechanism for the plurality of transport rollers is relatively complicated and expensive. Therefore, an alternative is desired.

SUMMARY OF THE INVENTION

In view of the aforementioned, an object of the present invention is to provide a printing plate discharging method and printing plate discharging device that can quickly and reliably discharge a printing plate that is laid on a surface plate from the surface plate without making the exposed face of the printing plate dirty or scratched.

A first aspect of the present invention is a device for discharging a printing plate from a face of a surface plate having a back end portion, the device comprising: (a) a lifting member having a printing plate supporting portion that is movable up and down relative to a face of a surface plate, such that when said printing plate supporting portion moves to a position higher than the face of the surface plate, said printing plate supporting portion lifts a back end portion of the printing plate from the face of the surface plate to a position higher than the face of the surface plate; (b) a cam mechanism provided at said lifting member which moves said lifting member up and down; and (c) a discharging member disposed along the surface plate, the discharging member being movable from the back end portion of the surface plate to a front end portion of the surface plate while holding the back end portion of the printing plate which has been lifted by said lifting member, for discharging the printing plate from the face of the surface plate.

In the printing plate discharging device of the first aspect, the printing plate supporting portion of the lifting member is moved up and down by operation of a cam mechanism. Thus, the back end portion of the printing plate is temporarily raised to the position higher than the surface of the surface plate. The raised back end portion is engaged by the discharging member, pushed in an engaged state toward the front end portion of the surface plate, and discharged from the surface plate.

A second aspect of the present invention is a method for discharging a printing plate from a face of a surface plate, comprising the steps of: (a) raising a back end portion of the printing plate to a position higher than the face of the surface plate with a printing plate supporting portion of a lifting member; (b) holding the raised back end portion with an discharging member; and (c) discharging the printing plate from the face of the surface plate by moving said discharging member from a back end portion of the face of the surface plate to a front end portion of the face of the surface plate, while said discharging member holds the back end portion of the printing plate.

In the printing plate discharging method of the second aspect, the back end portion of the printing plate is temporarily raised to the position higher than the surface of the surface plate. The raised back end portion is engaged, pushed in an engaged state toward the front end portion of the surface plate, and discharged from the surface plate.

Hence, in the printing plate discharging device and printing plate discharging method of the present invention, only the back end portion of the printing plate is held when the printing plate is discharged. Thus, a printing surface of the printing plate (the exposed face) is less susceptible to becoming dirty or scratched. Further, the structure is simple: the back end of the printing plate, which back end is protruding from the surface plate, is simply raised to a position higher than the printing plate and then engaged and pushed. Therefore, the structure can be implemented without complicated and expensive mechanisms (devices). The printing plate that is laid on the surface plate can be quickly and reliably discharged from on the surface plate without making the exposed face dirty or scratched.

BRIEF DESCRIPTION OF THE DRAWINGS

FIG. 9A in a state wherein temporary support arms are in a horizontal position, FIG. 9B in a state wherein the temporary support arms are in a retracted position, and FIG. 9C in a state wherein the temporary support arms are in a raised position.

DESCRIPTION OF THE PREFERRED EMBODIMENTS

Overall structure

Figure 1:
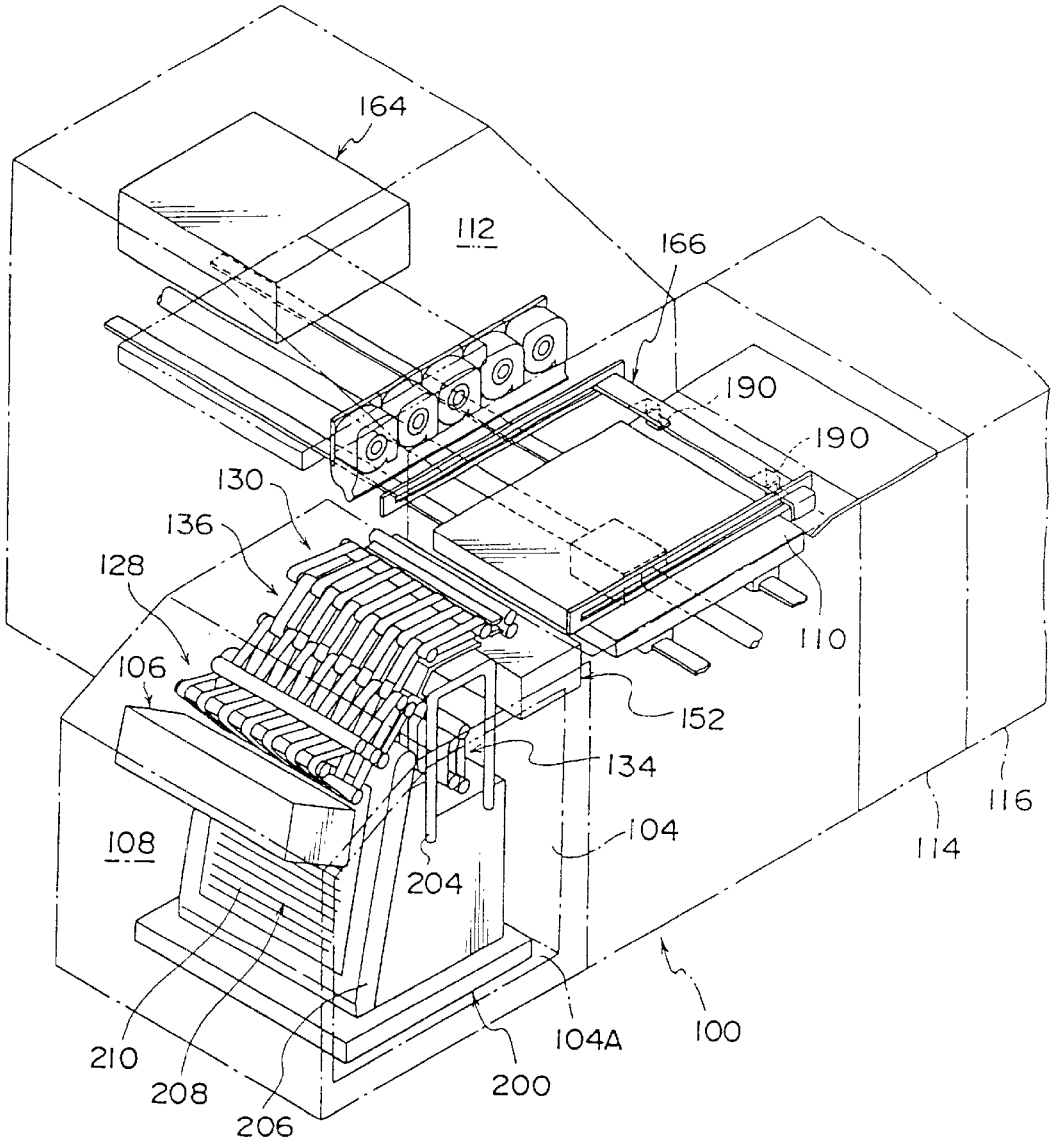
FIG. 1 is a perspective view showing an overall structure of an automatic exposure device relating to an embodiment of the present invention.

FIG. 1 shows a perspective view of the overall structure of a photopolymer plate (printing plate) automatic exposure device 100 constructed so as to use a printing plate discharging device relating to an embodiment of the present invention.

The automatic exposure device 100 is formed by a plate feed section 108, a surface plate 110 such as an exposure stage and an exposure section 112. The plate feed section 108 is provided with a plate accommodation section 104, which is mounted on a trolley 200 and which accommodates photopolymer plates 102 (see FIG. 2), and a sheet section 106, which takes out the photopolymer plates 102 accommodated at the plate accommodation section 104. At the surface plate 110, one of the photopolymer plates 102 is positioned and held. The exposure section 112 records an image onto the photopolymer plate 102 that is positioned on the surface plate 110.

Further, an automatic developing device 116 can be established at a downstream side of the automatic exposure device 100, via a buffer section 114. Thus, plate feeding, exposure and developing can all be processed automatically.

Figure 2:
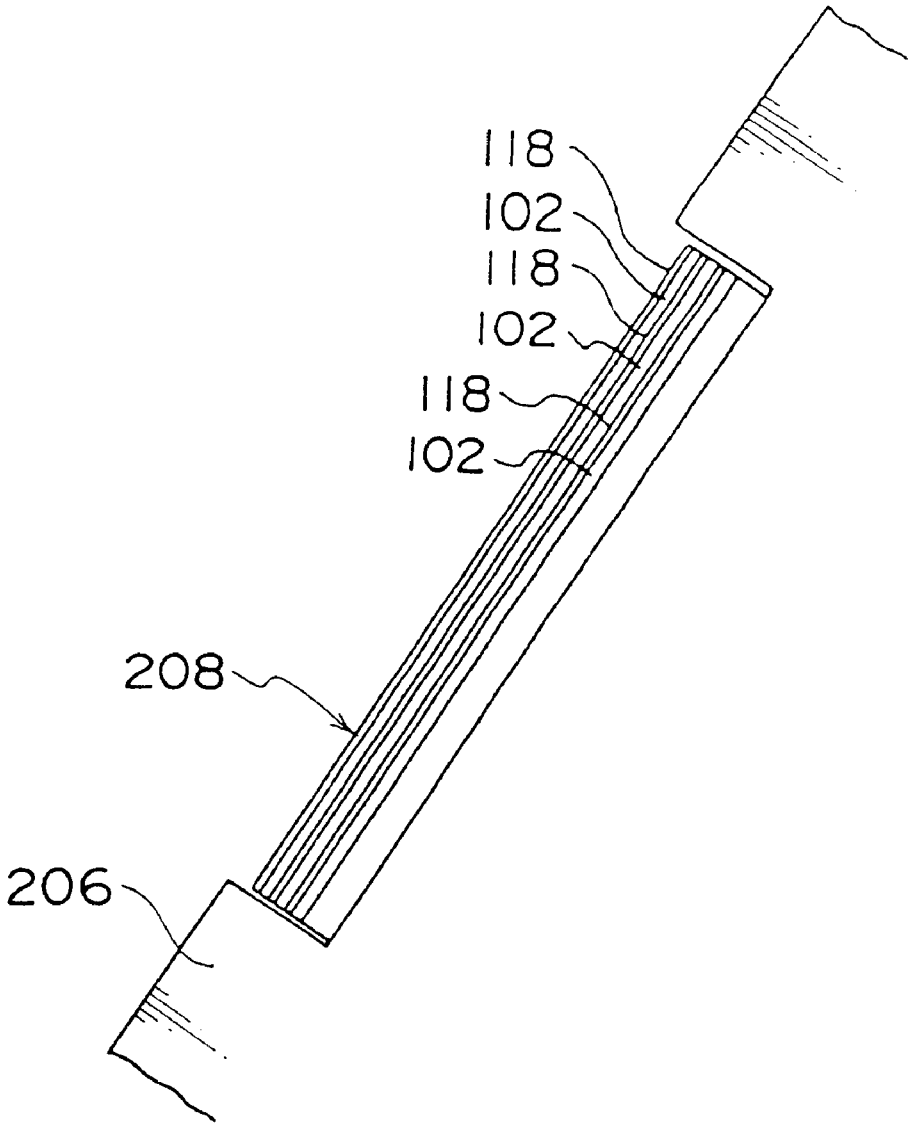
FIG. 2 is a side view showing a state of photopolymer plates and interleaf sheets loaded in a magazine.
Figure 3:
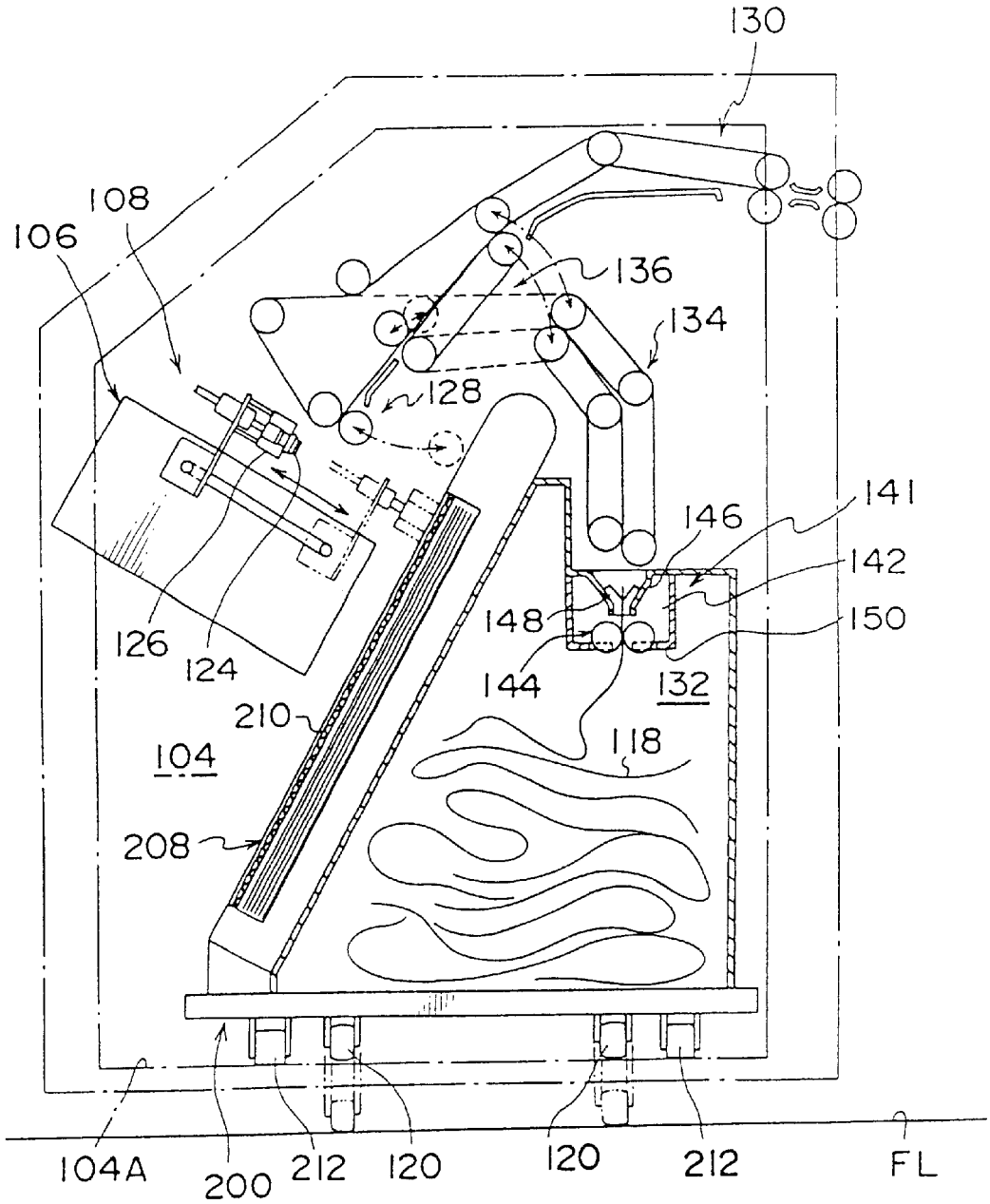
FIG. 3 is a side view of a plate feed section.

As shown in FIG. 3, a trolley 200, at which a plurality of photopolymer plates 102 are propped up, can be accommodated by the plate accommodation section 104. Further, as shown in FIG. 2, one protective interleaf sheet 118 is provided at the surface of each photopolymer plate 102. Thus, the photopolymer sheets 102 and the interleaf sheets 118 are stacked alternately.

A floor portion 104A of the plate accommodating section 104 is formed at a position higher than a track surface. The trolley 200 is a structure that lifts from the track surface to the floor portion 104A. That is, the trolley 200 is supported relative to the track surface by casters 120, which casters 120 can be moved relative to the trolley 200 between an extended position (a position shown by broken lines in FIG. 3) and an accommodated position (a position shown by solid lines in FIG. 3).

In accordance with an accommodation movement to the plate accommodating section 104, the casters 120 move so as to fold upward into the: accommodated position and, at the same time, help rollers 212 correspond with the floor portion 104A. Subsequently, the trolley 200 is supported relative to the floor portion 104A by the help rollers 212.

A sheet section 106 is provided at the upper portion of the plate accommodation section 104. The sheet section 106 alternately takes photopolymer plates 102 and interleaf sheets 118 from the stacked state thereof and passes them onto the plate feed section 108. The sheet section 106,is provided with a sucker 124 which sucks the photopolymer plates 102 and the interleaf sheets 118. Further, in the vicinity of the sucker 124 but separate therefrom, a suction fan 126 is provided, as a means of assistance when one of the interleaf sheets 118 is being sucked. The sucker 124 and the suction fan 126 can be integrally moved closer to and further away from the surface of the stack of interleaf sheets 118 and photopolymer plates 102.

When one of the photopolymer plates 102 is to be sucked, the sucker 124 makes contact with the photopolymer plate 102 and sucks. However, when one of the interleaf sheets 118 is to be sucked, the suction fan 126 is disposed a small distance from the interleaf sheet 118 (contact is acceptable) and the suction fan 126 operates alone such that only the lightweight, thin interleaf sheet 118 is sucked up, after which the sucker 124 starts to suck. Hence, when the interleaf sheet 118 is sucked, double suction (sucking the photopolymer plate 102 underneath together with the interleaf sheet 118) is prevented.

The major sections forming the plate feed section 108 are a common transport section 128, a photopolymer plate transport section 130, an interleaf sheet transport section 134, and a switching transport section 136. The common transport section 128 receives the photopolymer plates 102 and the interleaf sheets 118 from the aforementioned sheet section 106. The photopolymer plate transport section 130 receives the photopolymer sheets 102 and sends the same to the surface plate 110. The interleaf sheet transport section 134 receives the interleaf sheets 118 and sends the same to an interleaf sheet accommodation box 132 (mounted at the trolley 200). The switching transport section 136 switches to guide a photopolymer plate 102 or interleaf sheet 118 from the common transport section 128 to one of the photopolymer plate transport section 130 and the interleaf sheet transport section 134.

The photopolymer plates 102 and the interleaf sheets 118 are alternately stacked. Therefore, the switching transport section 136 switches each time the sheet section 106 sucks and the plate feed section 108 is a structure that transports the photopolymer plates 102 and the interleaf sheets 118 respectively in predetermined directions.

Figure 4A:
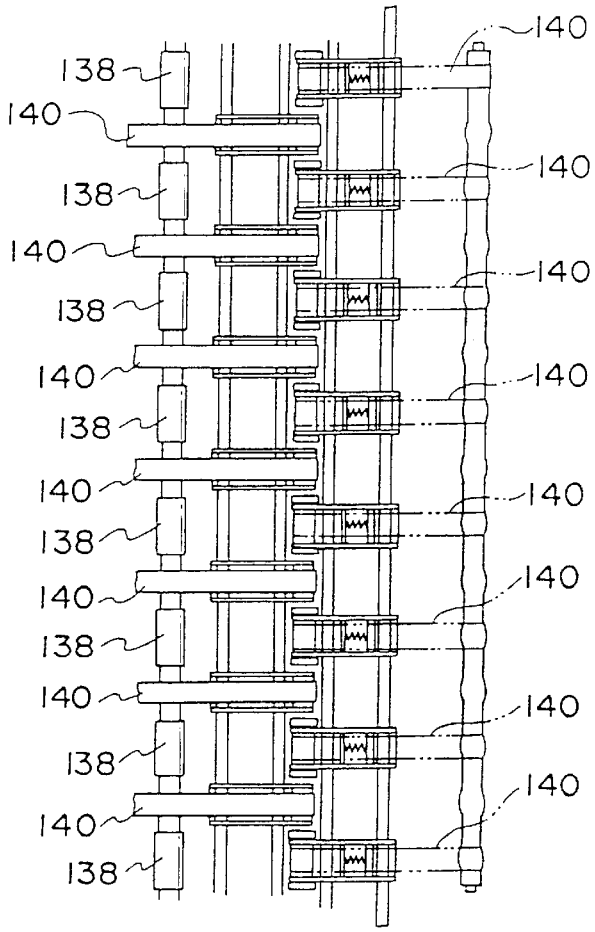
FIG. 4A is a plan view showing a part of a transport apparatus of the plate feed section.
Figure 4B:
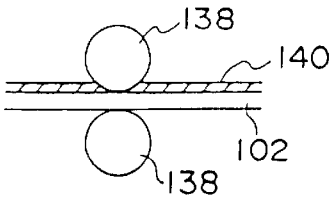
FIG. 4B is a side view of a common transport section, a photopolymer plate transport section or a switching transport section.

As shown in FIG. 4A, at the common transport section 128, the photopolymer plate transport section 130 and the switching transport section 136, skewered rollers 138 and narrow belts 140 are combined to form a transport system, whose main purpose is transporting the photopolymer plates 102 (see FIG. 4B). The photopolymer plates 102 are transported by strong gripping force of the skewered rollers 138, and the narrow belts 140 serve as moving guide plates during transport.

Figure 4C:
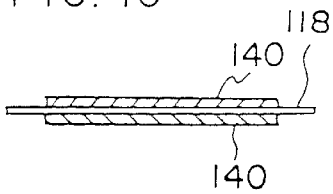
FIG. 4C is a side view of an interleaf sheet transport section.

At the interleaf sheet transport section 134, however, narrow belts 140 alone form a transport system, as shown in FIG. 4C. In this structure, the interleaf sheets 118 are transported by weak gripping force of the narrow belts 140.

Figure 5:
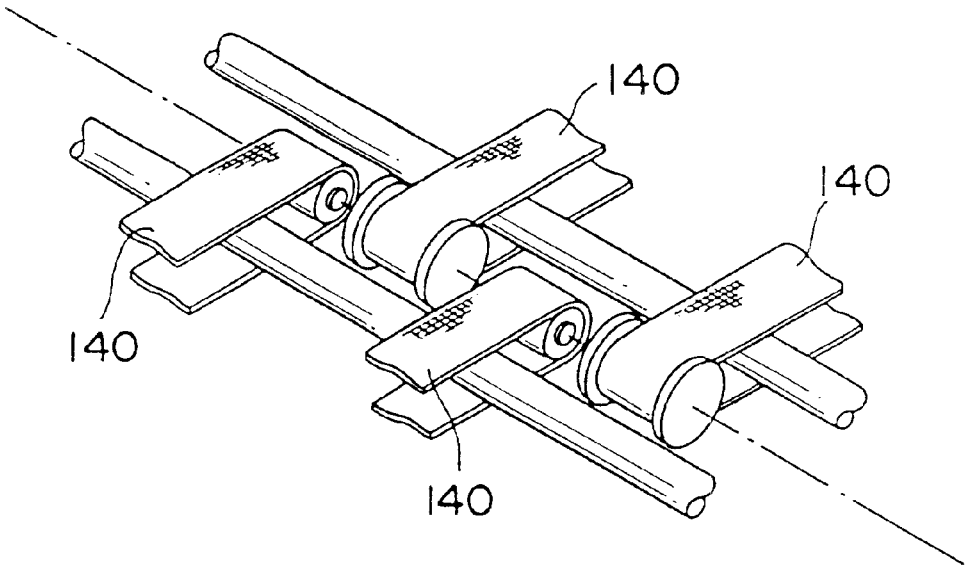
FIG. 5 is a perspective view showing a transfer portion of a transport apparatus which is not a plate feed section.

As shown in FIG. 5, the hand-over portion between two transport sections is in a skewered shape with end portions of the transport sections protruding respectively alternately, such that where one transport section protrudes the other recedes, and vice versa. Thus, the two transport sections intermesh from opposite sides (with narrow belt end portion support rollers having a common axis). Therefore, at a time of hand-over of one of the photopolymer plates 102 or one of the interleaf sheets 118, wrapping thereof around the skewered rollers 138 and the narrow belts 140 is prevented.

As shown in FIG. 3, the interleaf sheets 118 that are transported by the interleaf sheet transport section 134 are guided by a sheet material forced collection device 141 provided at the trolley 200 to the interleaf sheet accommodation box 132.

Figure 6:
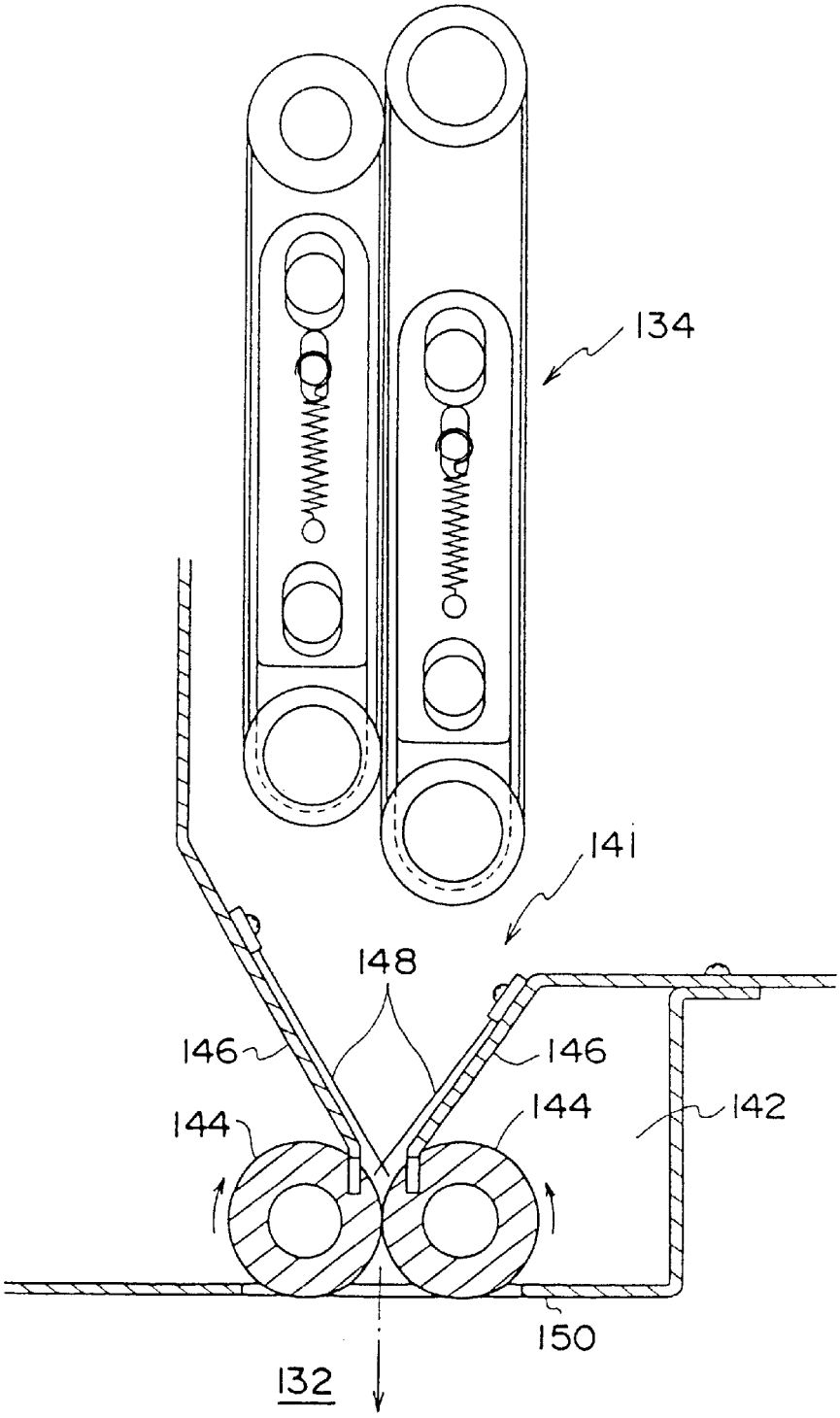
FIG. 6 is a sectional view showing the details of a sheet material forced collection device.

Details of the sheet material forced collection device 141 are shown in FIG. 6.

Figure 7:
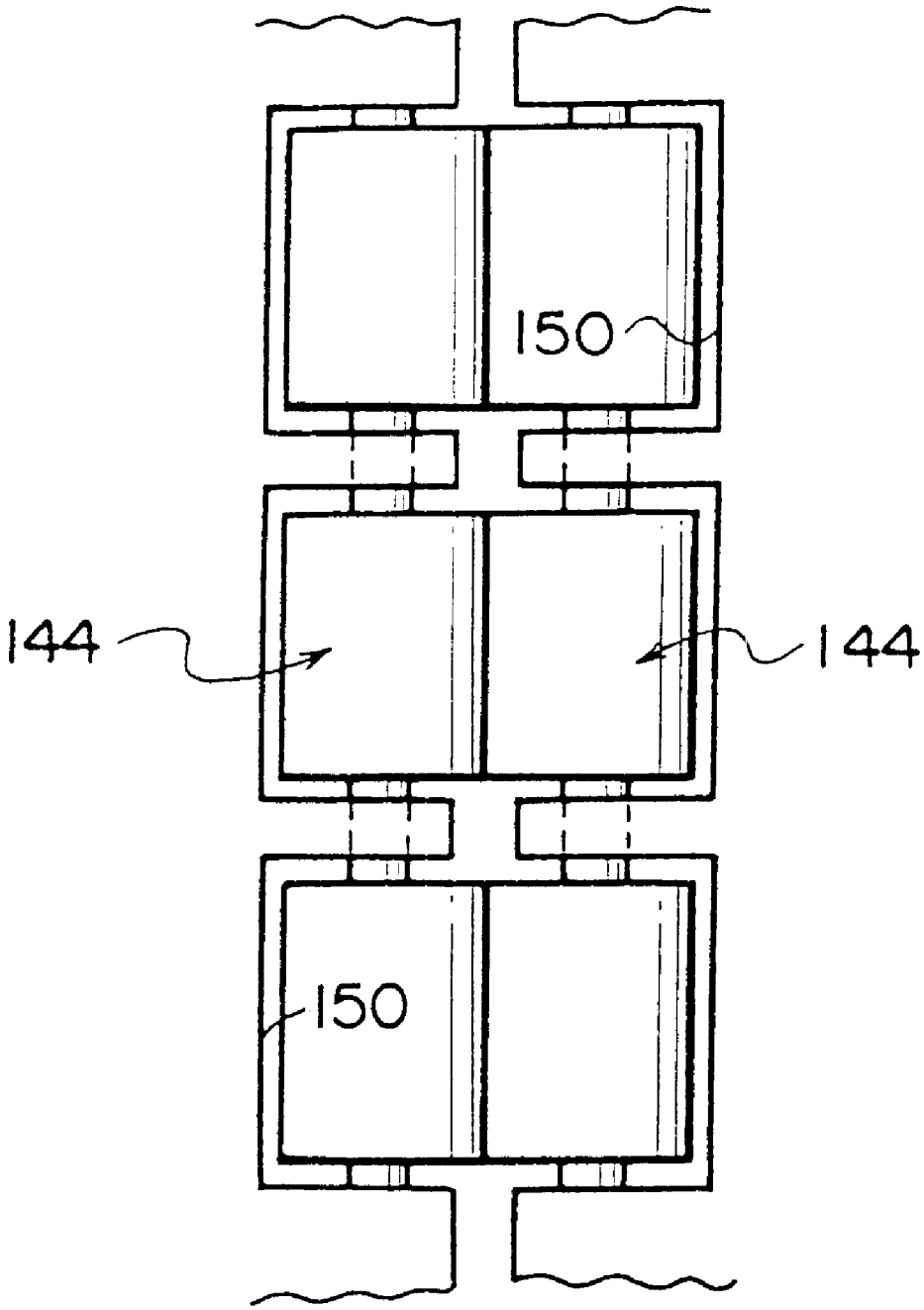
FIG. 7 is a plan view showing rollers of the sheet material forced collection device and wraparound prevention boards.

In the sheet material forced collection device 141, a pair of rollers 144, serving as gripping feed rollers, are provided at an interleaf sheet 118 insertion slot 142, which insertion slot is provided at an upper portion of the interleaf sheet accommodation box 132. As shown in FIG. 7, the rollers 144 have skewered forms. The rollers 144 are rotarily driven at a linear speed slightly faster than the speed of the interleaf sheet transport section 134 (about 1.1 times as fast). Thus, when one of the interleaf sheets 118 passes down between the rollers 144, the interleaf sheet 118 maintains a state of predetermined tension (a so-called pulling method) as it is transported, and jamming due to slackness and the like can be prevented.

At the interleaf sheet transport section 134 side of the insertion slot 142, guide plates 146 are provided, which gradually taper to reduce the width therebetween (which width is in the direction of thickness of the interleaf sheets 118) and which face each other. At the thus tapered guide plates 146, anti-static brushes 148 are respectively attached, which anti-static brushes 148 remove electric charge from the interleaf sheets 118 that are inserted into the insertion slot 142.

At a vicinity below the aforementioned pair of rollers 144, wraparound prevention boards 150 are provided such that edges thereof follow along projections and indentations of the skewered shapes of the rollers 144. Hence, after interleaf sheets 118 have passed between the rollers 144 and been accumulated in the interleaf sheet accommodation section 132, even if a part of one of the accumulated interleaf sheets 118 touches one of the rollers 144, the respective wraparound prevention board 150 can prevent the interleaf sheet 118 wrapping around the one of the rollers 144.

As shown in FIG. 1, the one of the photopolymer plates 102 that is transported by the photopolymer plate transport section 130 leaves the photopolymer plate transport section 130 in a horizontal state and is handed over to the surface plate 110.

A top surface height of the surface plate 110 is at a lower position than a height of horizontal transport from the photopolymer plate transport section 130 and a little separated therefrom in the transport direction. Therefore, when discharged from the photopolymer plate transport section 130, the photopolymer plate 102 hangs down a little when landing on the surface plate 110, and the transport direction back end of the photopolymer plate 102 is disposed in a position further toward the photopolymer plate transport section 130 side than the surface plate 110. As shown in FIG. 8B, temporary support arms 154 serving as lifting members are disposed at the photopolymer plate transport section 130 side of the surface plate 110, to prevent the photopolymer plate 102 from hanging down.

A moving body 152, which can move toward and away from the surface plate 110, is provided in a vicinity of the temporary support arms 154. A pushing plate 156, which pushes the back end of the photopolymer plate 102 in the transport direction, is disposed at the moving body 152. When the pushing plate 156 pushes the back end of the photopolymer plate 102, obliqueness of the photopolymer plate 102 is corrected and the photopolymer plate 102 can be moved to a predetermined standard position in the transport direction. When the photopolymer plate 102 is at this standard position, the transport direction back end portion thereof is in a slightly projecting state from the surface plate 110.

Figure 8A:
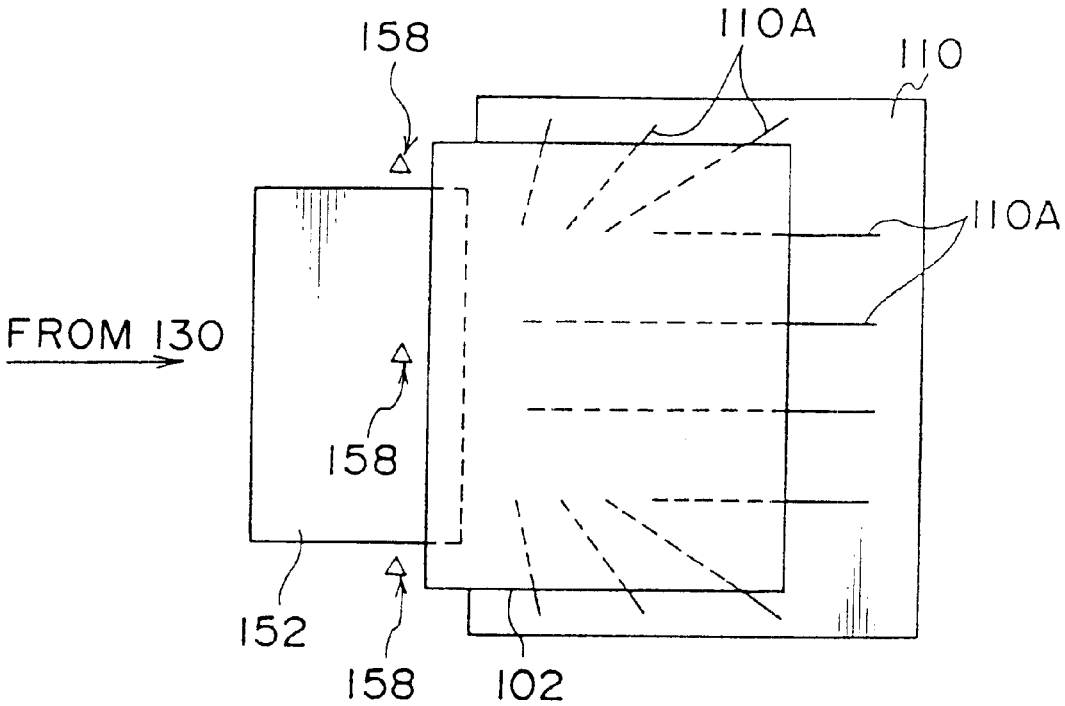
FIG. 8A is a plan view of a surface plate.
Figure 8B:
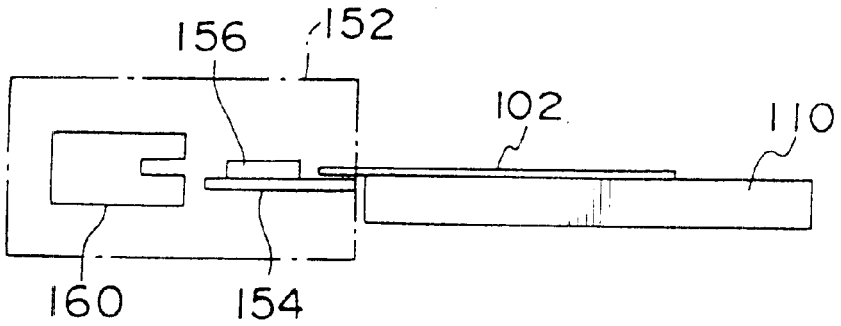
FIG. 8B is a side view of the surface plate.

As shown in FIG. 8A, for this standard position, sensors 158 are provided at a plurality of positions, including both corner portions of the transport direction back end portion of the photopolymer plate 102. When these sensors 158 detect the transport direction back end portion of the photopolymer plate 102, push of the pushing plate 156 is stopped. Further, the sensors 158 are also used for position detection across the transport direction of the photopolymer plate 102. Specifically, the surface plate 110 moves in a direction transverse to the transport direction to make the sensors 158 and the corners of the photopolymer plate 102 correspond. This position is recorded as an initial position of the photopolymer plate 102.

The photopolymer plate 102, which has been moved to the initial position, is positioned relative to an exposure scanning start position at an exposure section 112, and is held in this state by suction from suction channels 110A which are provided at the surface plate 110.

Punch holes are made at the photopolymer plate 102, which is being held by suction, by a puncher 160 which is provided at the aforementioned moving body 152.

Further, in order to be positioned along a direction transverse to the transport direction, the surface plate 110 can move at a uniform velocity in both directions between a first position, at which the surface plate 110 receives the photopolymer plate 102 from the photopolymer plate transport section 130, (see the position shown by solid lines in FIG. 1) and a second position, at which the surface plate 110 is accommodated at the exposure section 112 (see the position shown by broken lines in FIG. 1).

At the exposure section 112, a scanning unit 164 is provided above a transport path of the surface plate 110. A laser beam, whose light is controlled according to an image signal, forms a main scanner (in a direction orthogonal to a transport direction of the surface plate 110). Outward transport of the surface plate 110 (toward the exposure section 112) is a sub-scanning movement. Thus, at the exposure section 112, an image is recorded onto the photopolymer plate 102 on the surface plate 110 at the time of the outward transport. The surface plate 110 is returned to an original position by return transport (away from the exposure section 112). Further, when the photopolymer plate 102 on the surface plate 110 has returned to the original position, the suction holding the photopolymer plate 102 is released.

In response to the image being written and the surface plate 110 being returned to the original position, a discharge mechanism section 166 is provided at the photopolymer plate 102 transport direction back end side of the photopolymer plate transport section 130 (in a vicinity of the moving body 152) to serve as a printing plate discharging device.

FIG. 9 shows an overview of the structure of the discharge mechanism section 166. At the discharge mechanism section 166, the aforementioned pair of temporary support arms 154 are rotatably supported via a spindle 170 at a stage base 168. A distal end portion of each temporary support arm 154 is positioned in a vicinity of the support plate 110. At a bottom face side of each of at least one of the temporary support arms 154, a level portion 172, a recessed portion 174 and a projecting portion 176, forming a cam mechanism, are formed with respectively different height (depth) dimensions.

A moving stage 178, forming the same cam mechanism, is disposed below each of at least one of the temporary support arms 154. The each moving stage 178 is movable along the respective temporary support arm 154. Further, at a distal end portion of the moving stage 178, a roller 180 which abuts against the bottom face of the temporary support arm 154 is provided. Therefore, when the moving stage 178 moves, the position of abutting support of the roller 180 (at one of the level portion 172, the recessed portion 174 and the projecting portion 176) changes, so the height of the temporary support arm 154 distal end changes. Further, a spring 182 is joined at a proximal end portion of the temporary support arm 154. Thus, the temporary support arm 154 always follows the movement of the moving stage 178.

Figure 9A:
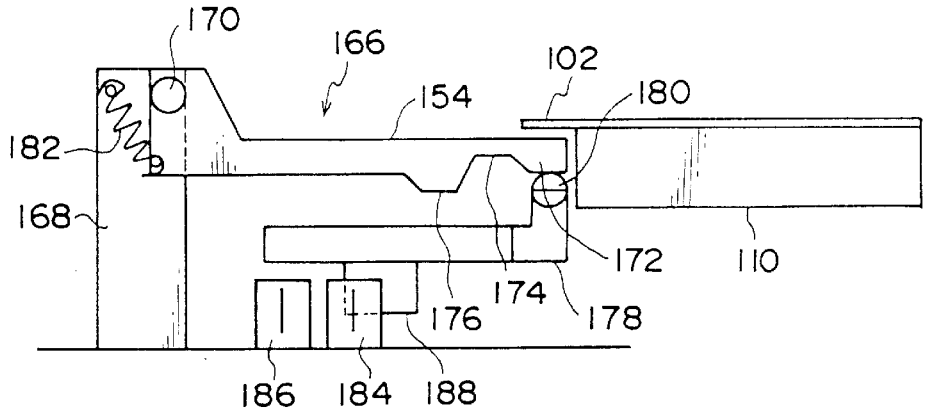
FIGS. 9A, 9B and 9C are side views showing the operation of a discharge mechanism section.
Figure 9B:
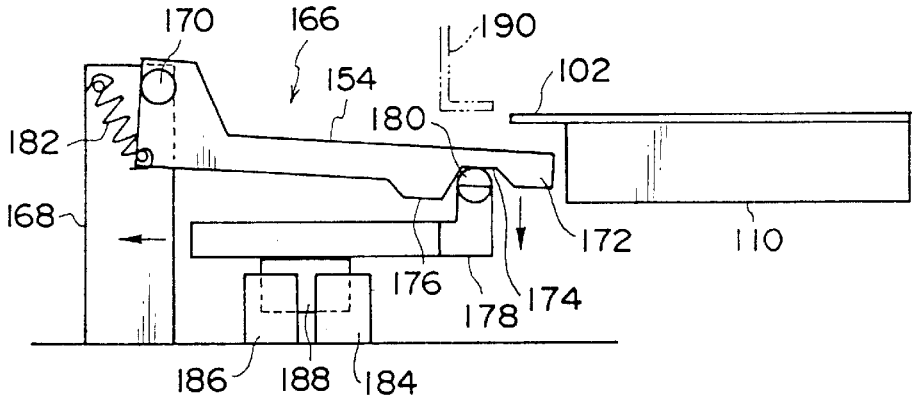
Figure 9C:
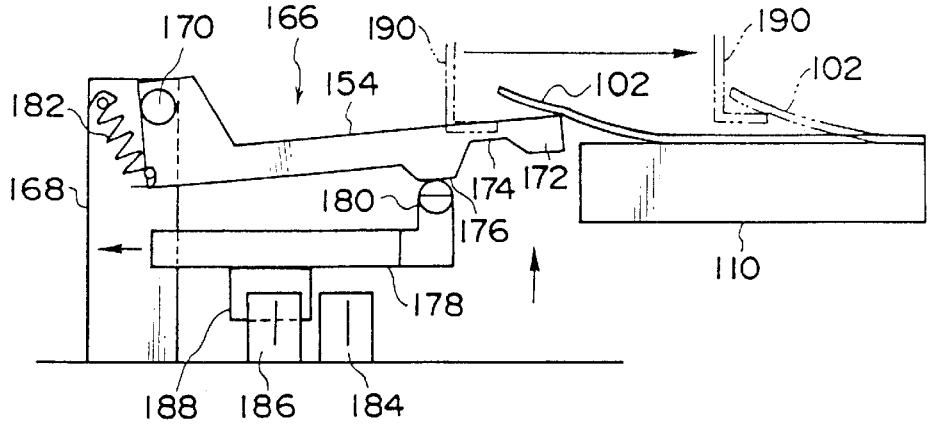

The dimensions of the respective portions are set such that: when the roller 180 abuttingly supports the level portion 172, the temporary support arm 154 is horizontally positioned at the same height as the surface plate 110, as shown in FIG. 9A; when the roller 180 abuttingly supports the recessed portion 174, the temporary support arm 154 is retractedly positioned at a lower height than the surface plate 110, as shown in FIG. 9B; and when the roller 180 abuttingly supports the projecting portion 176, the temporary support arm 154 is raisedly positioned at a higher height than the surface plate 110, as shown in FIG. 9C. Therefore, when the roller 180 of the moving stage 178 abuttingly supports the level portion 172 of the temporary support arm 154, the temporary support arm 154 is horizontally positioned at the same height as the surface plate 110, and thus the photopolymer plate 102 on the support plate 110 can be prevented from hanging down. Further, when the roller 180 of the moving stage 178.abuttingly supports the projecting portion 176 of the temporary support arm 154, the temporary support arm 154 is raisedly positioned at a higher height than the surface plate 110, and thus the temporary supporting arm 154 is a structure that can lift up the back end portion of the photopolymer plate 102 that is on the support plate 110.

A pair of sensors 184 and 186 are disposed at a lower side of at least one of the moving stages 178. The sensors 184 and 186 detect a lug 188, which is provided at the respective moving stage 178. Thus, the sensors 184 and 186 can detect the position of the moving stage 178, and hence the position of the temporary support arm 154. That is, the sensors 184 and 186 and the lug 188 are a structure such that: when only the sensor 184 detects the lug 188, the temporary support arm 154 is understood to be horizontally positioned at the same height as the surface plate 110; when the sensors 184 and 186 both detect the lug 188, the temporary support arm 154 is understood to be retractedly positioned at a lower height than the surface plate 110; and when only the sensor 186 detects the lug 188, the temporary support arm 154 is understood to be raisedly positioned at a higher height than the surface plate 110.

Figure 10:
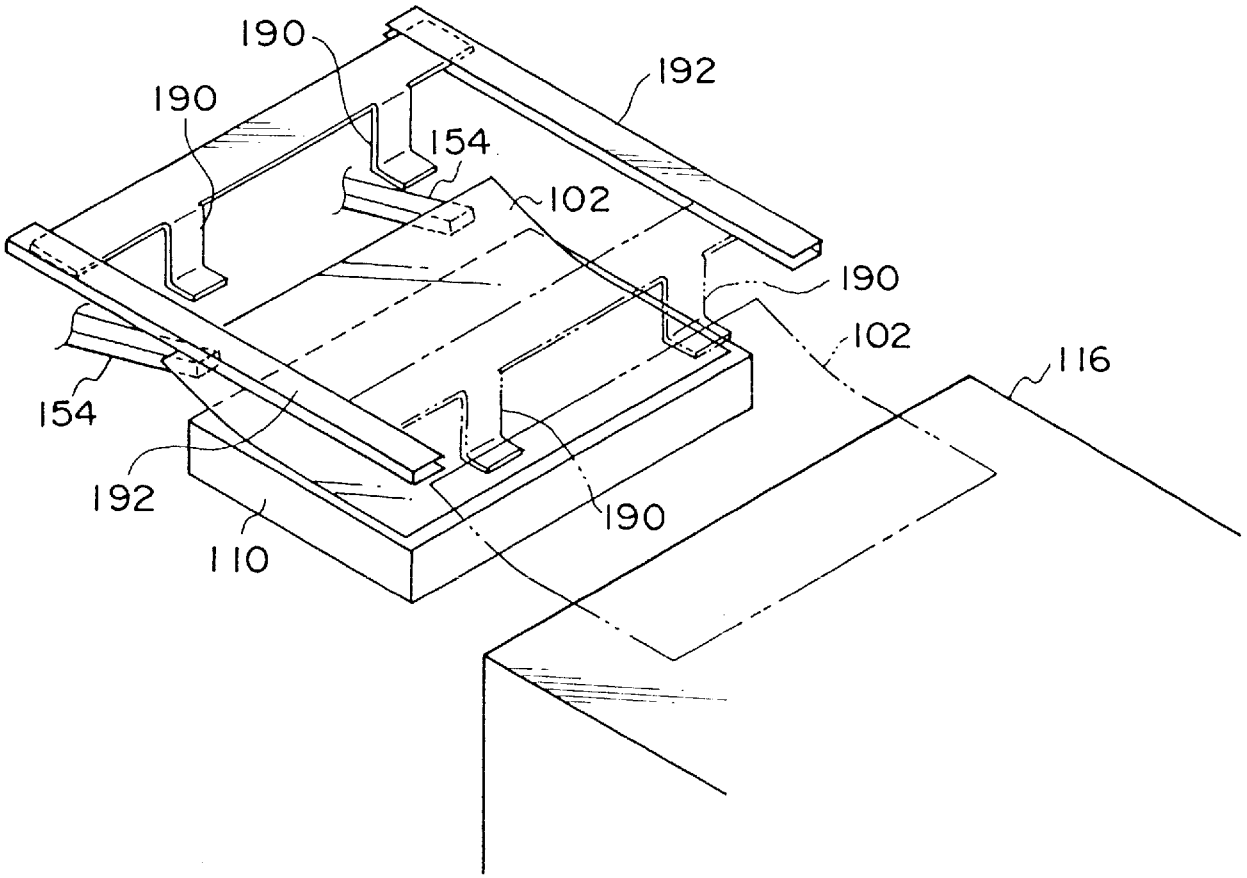
FIG. 10 is a perspective view showing plate discharging pawls of the discharge mechanism section.

At the discharge mechanism section 166, a pair of plate discharging pawls 190 are provided at an upper side of the temporary support arms 154. As shown in FIG. 10, this pair of discharging pawls 190 can move along guide rails 192 which are disposed in a direction along the surface plate 110. That is, the plate discharging pawls, 190 pass above the surface plate 110 and move toward the transport direction front end of the photopolymer plate 102.

These plate discharging pawls 190 move in the photopolymer plate 102 transport direction when the photopolymer plate 102 back end, which is projecting from the surface plate 110, is in a previously described state wherein it is lifted up by the temporary support arms 154. Thus, the plate discharging pawls 190 can engage the photopolymer plate 102. Therefore, in this structure, the photopolymer plate 102 is engaged by the plate discharging pawls 190, moves along with the plate discharging pawls 190, and is transported to a downstream side of the surface plate 110.

At the downstream side of the surface plate 110, a buffer section 114 is provided and an automatic development device 116 is further provided. The buffer section 114 absorbs a difference between an discharging speed of the discharge mechanism section 166 and a transport speed of the automatic development device 116, and delivers the photopolymer plates 102 smoothly.

Detailed structure of the trolley 200

Figure 11:
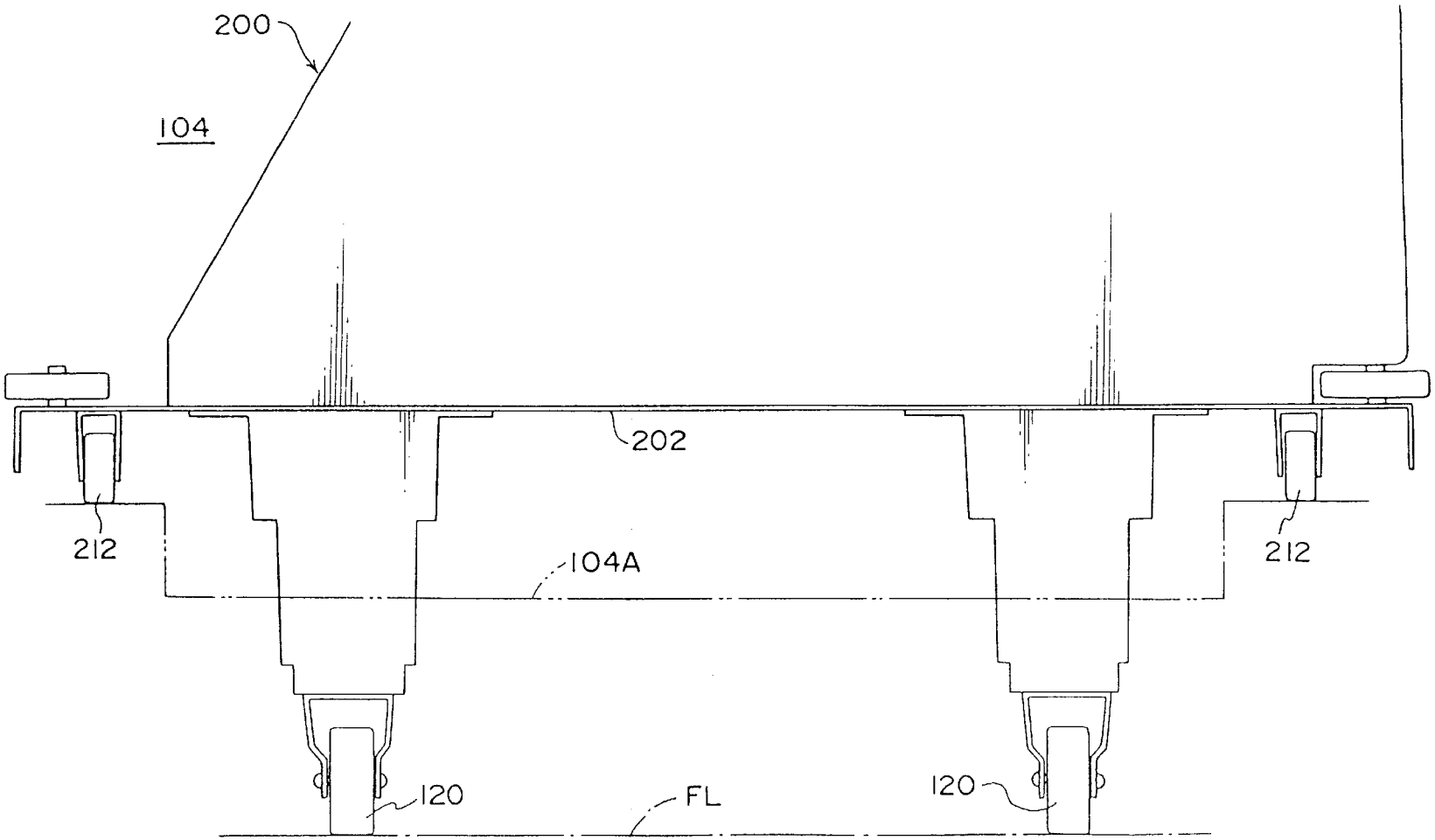
FIG. 11 is an enlarged side view of a bottom portion of a trolley.

The trolley 200 is shown in FIG. 1 and FIG. 11. The trolley 200 has a loading platform 202, which is supported at a track surface FL via the four casters 120 (only two of which are shown in FIG. 11). A handle 204 is attached at the loading platform 202. The handle 204 is substantially curved in a U shape. Both ends of the handle 204 are abuttedly fixed at the loading platform 202.

An accumulation section 206, which holds the stacked photopolymer plates 102, is provided at the loading trolley 202. Viewed sideways on, this accumulation section 206 is substantially in the form of a right angled triangle. A magazine 208, which accommodates the photopolymer plates 102, is propped up at a slanted face portion of the accumulation section 206.

At the magazine 208, tens of photopolymer plates 102 are stacked in advance (normally 60 plates, but up to 100 plates can be set). Also, a shutter 210 is provided at the magazine 208. Except when in a darkroom, this shutter 210 is left in a closed state to prevent exposure of the photopolymer plates 102.

That is, the trolley 200 can convey the photopolymer plates 102 between the aforementioned accommodation section 104 and a darkroom in which the photopolymer plates 102 are stored, and the shutter 210 can protect the photopolymer plates 102 during conveyance.

A side of the trolley 200 to which the handle 204 is attached faces backward at a time of conveyance. The handle 204 is accommodated at the plate accommodation section 104.

As shown in FIG. 11, the plate accommodation section 104 is a box-form space having a floor portion 104A, which is disposed higher than the track surface FL. The trolley 200 can be supportedly accommodated at the floor portion 104A. At such a time, the casters 120 of the trolley 200 are folded up and the trolley 200 is supported by a plurality of help rollers 212 (six in the present embodiment), which are attached at the bottom surface of the loading platform 202.

Figure 12:
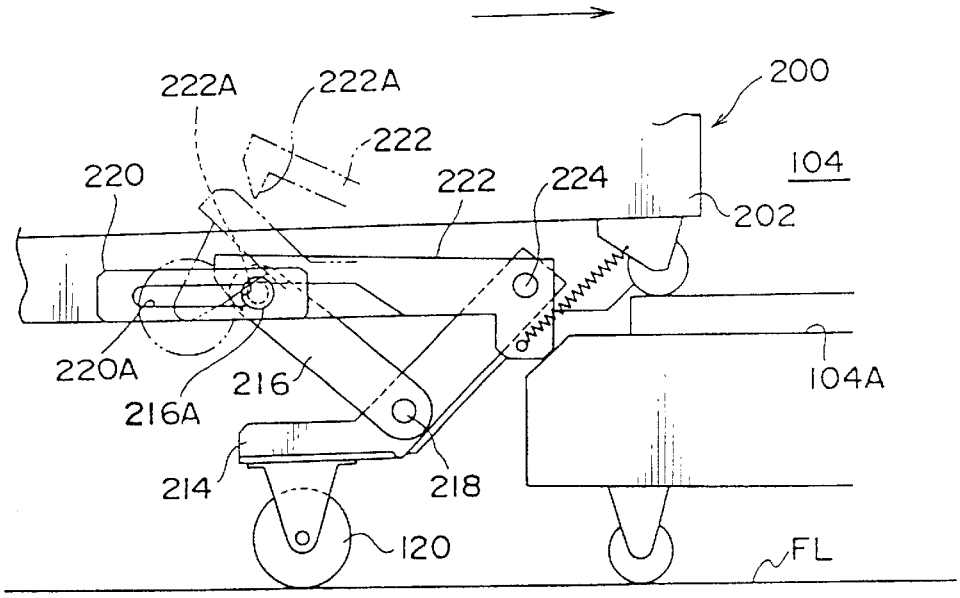
FIG. 12 is a side view showing a structure of a caster accommodation mechanism section.

The casters 120 fold up synchronously with a movement accommodating the trolley 200 at the plate accommodation section 104. As shown in FIG. 12, each of the casters 120 is attached at another end of a main arm 214, one end of which is rotatably supported. One end of a support arm 216 is rotatably attached, via a spindle 218, at a longitudinal direction central portion of the main arm 214. A slidepin 216A is attached at another end of the support arm 216. The slidepin 216A is accommodated at a long hole 220A of a fixed rail arm 220.

In a usual state (wherein the casters 120 are fixed), a hook portion 222A, which is formed at one end portion of an L-shaped arm 222, engages the slidepin. Thus, the slidepin 216A is maintained at a vicinity of one end portion of the long hole 220A.

A bent portion of the L-shaped arm 222 is supported, via a spindle 224, at the main arm 214. Another end of the L-shaped arm 222 is disposed at a position that can abut an end surface of the floor portion 104A of the plate accommodation section 104.

If the L-shaped arm 222 other end portion, when in a state abutting the floor portion 104A end surface, is pushed further, the L-shaped arm 222 rotates about the spindle 224, and the hook portion 222A is removed from the slide pin 216A.

After the hook portion 222A is removed from the slide pin 216A, the support arm 216, to which the slidepin 216A is attached, is moved toward another end portion of the long hole 220A by an urging force of an urging means. Thus, as the support arm 216 moves, the main arm 214 is lifted up and the caster 120 is removed from the track surface (FL). At this time the trolley 200 is supported at the floor portion 104A via the help rollers 212.

The operation of the present embodiment is described below.

When the photopolymer plates 102 are accommodated at the plate accommodation section 104 of the automatic exposure device 100, the photopolymer plates 102 are accommodated therein along with the trolley 200. Thus, the photopolymer plates 102 can be disposed at a predetermined position.

The photopolymer plates 102 are stored away from the automatic exposure device 100, at a darkroom or the like. An operator pushes the trolley 200 to the darkroom. In the darkroom, the photopolymer plates 102 are loaded, as a unit in the magazine 208, at a predetermined position (accumulation section 206) at the trolley. At this time, the shutter of the magazine 208 is left closed.

After the magazine 208 has been loaded, the trolley 200 is conveyed back to the automatic exposure device 100. A door of the plate accommodation section 104 (at the near side of FIG. 3) is opened. The trolley 200 is accommodated inside the plate accommodation section 104.

Although the floor portion 104A of the plate accommodation section 104 is at a position higher than the track surface FL, in the present embodiment the casters 120 fold up. Thus, the height position of the trolley 200 does not change at the time of accommodation, and the trolley 200 can be accommodated at the floor portion 104A of the plate accommodation section 104. That is, support of the trolley 200 is handed over from the casters 120 to the help rollers 212. Hence, the trolley 200 can smoothly pass over a height discontinuity from the track surface FL to the floor portion 104A. Consequently, a periphery of the plate accommodation section 104 can be a high rigidity structure enclosed by a frame (so-called a closed section structure), and a cover with excellent light protection characteristics can be used.

After the trolley 200 has been accommodated in the plate accommodation section 104, the photopolymer plates 102 and the interleaf sheets 118 are taken out from the alternately stacked state thereof by the sucker 124 and the suction fan 126 at the sheet section 106. The photopolymer plates 102 and the interleaf sheets 118 are sent to the plate feed section 108. Further, the interleaf sheets 118 are transported by the common transport section 128 and the interleaf sheet transport section 134, and accumulated at the interleaf sheet accommodation box 132 by the sheet material forced collection device 141.

Meanwhile, the photopolymer plates 102 are transported by the common transport section 128 and the photopolymer plate transport section 130, and sent to the surface plate 110. The one of the photopolymer plates 102 at the surface plate 110 is positioned at a predetermined position, held by suction, and provided with punch holes by the puncher 160.

The back end portion of the photopolymer plate 102 projects from the surface plate 110 (and is disposed slightly towards the photopolymer plate transport section 130). As shown in FIG. 9A, the roller 180 of the moving stage 178 abuts against the level portion 172 of at least one of the temporary support arms 154 provided at the discharge mechanism section 166. Thus, the temporary support arms 154 are horizontally disposed at the same height as the surface plate 110. Hence, the photopolymer plate 102 on the surface plate 110 is prevented from hanging down.

Next, the surface plate 110 moves to the exposure section 112. A predetermined image is exposed by scanning onto the photopolymer plate 102 by a scanning unit 164. After scanning, the surface plate 110 returns to the original position thereof. Further, suction holding the photopolymer plate 102 on the surface plate 110 is released.

After that, the photopolymer plate 102 is discharged from the surface plate 110 by the discharge mechanism section 166.

That is, as shown in FIG. 9C, the moving stage 178 moves and the roller 180 abuts against the projecting portion 176 of the temporary support arm 154. Hence, the temporary support arms 154 are raisedly positioned higher than the surface plate 110, and the back end portion of the photopolymer plate 102 on the surface plate 110 is temporarily raisedly positioned at a higher height than the surface plate 110. In this state, the back end portion of the photopolymer plate 102 is engaged by the plate discharging pawls 190, which were in a state of readiness, moving in the transport direction of the photopolymer plate 102. The photopolymer plate 102, which has been engaged by the plate discharging pawls 190, moves along with the plate discharging pawls 190 to the downstream side of the surface plate 110 and is discharged. The photopolymer plate 102 is sent to the automatic developing device 116.

Hence, at the discharge mechanism section 166 relating to the present embodiment, the photopolymer plate 102 is discharged with only one end portion (the back end portion) thereof being engaged by the plate discharging pawls 190. Thus, it is unlikely that a plate face of the photopolymer plate 102 (an exposed face) will thereby become dirty or be scratched. Further, the structure is simple, in that the one end portion of the photopolymer plate 102 that projects from the surface plate 110 is raised to a higher position than the surface plate 110 only by the temporary support arms 154, and after that is engaged and pushed only by the plate discharging pawls 190. Thus, the mechanism can easily be implemented at low cost.

Hence, at the discharge mechanism section 166 relating to the present embodiment, the photopolymer plate 102, which is laid in a state wherein one end portion thereof projects from the surface plate 110, can be quickly and reliably discharged from the surface plate without becoming dirty or being scratched.

As described above, the printing plate discharging method and printing plate discharging device relating to the present invention are very effective in that a printing plate, which is laid in a state wherein one end portion thereof projects from a surface plate, can be quickly and reliably discharged from the surface plate without becoming dirty or scratched.

What is claimed is:

1. A device for discharging in a discharge direction a printing plate, having a front end portion and a back end portion, from a face of a surface plate, having a front end portion and a back end portion, wherein the back end portion of the printing plate is a trailing end portion of the printing plate when the printing plate is conveyed in the discharge direction from the back end portion to the front end portion of the surface plate, the device comprising:

(a) at least one lifting member having a printing plate supporting portion that is movable up and down relative to the face of the surface plate, said printing plate supporting portion being configured such that when said printing plate supporting portion moves to a position higher than the face of the surface plate said printing plate supporting portion lifts the back end portion of the printing plate from the face of the surface plate to the position higher than the face of the surface plate;

(b) a cam mechanism provided at said at least one lifting member which moves said at least one lifting member up and down; and (c) at least one discharging member disposed along the surface plate, said at least one discharging member configured to move from the back end portion of the surface plate to the front end portion of the surface plate while holding the back end portion of the printing plate which has been lifted by said at least one lifting member, for discharging the printing plate from the face of the surface plate by pushing the printing plate in the discharge direction.

2. The device of claim 1, wherein said at least one lifting member includes a back end portion, the back end portion of said at least one lifting member being rotatably supported at a pivot axis, with said printing plate supporting portion of said at least one lifting member being movable up and down with respect to the face of the surface plate by rotation about said pivot axis.

3. The device of claim 2, wherein said at least one lifting member includes a spring member provided at said back end portion of said at least one lifting member, with the spring member urging said at least one lifting member downward.

4. The device of claim 1, wherein said at least one lifting member comprises a plurality of lifting members, said plurality of lifting members are all provided along an axis, and wherein said at least one discharging member comprises a plurality of discharging members, said plurality of discharging members are provided along the direction of the axis, at positions that are non-coincident with said plurality of lifting members.

5. The device of claim 1, wherein said at least one lifting member includes a lower surface, and the cam mechanism comprises:

(a) a discontinuous portion provided longitudinally along the lower surface of said at least one lifting member; and (b) a stage which is movable along a longitudinal direction of said at least one lifting member, and which has a roller that abuts against said lower surface of said at least one lifting member for pushing said at least one lifting member upward.

6. The device of claim 5, wherein said discontinuous portion includes a projecting portion, a recessed portion and a level portion.

7. The device of claim 6, configured such that, when said stage moves to a position such that said roller abuts against said projecting portion of said lower surface of said at least one lifting member, said at least one lifting member moves to a printing plate raising position higher than the face of the surface plate.

8. The device of claim 6, configured such that, when said stage moves to a position such that said roller abuts against said level portion of said lower surface of said at least one lifting member, said at least one lifting member moves to a horizontal position at substantially the same height as the face of the surface plate.

9. The device of claim 6, configured such that, when said stage moves to a position such that said roller abuts against said recessed portion of said lower surface of said at least one lifting member, said at least one lifting member moves to a retracted position lower than the face of the surface plate.

10. The device of claim 5, further comprising at least one sensor which detects a position along the direction of movement of said stage.

11. The device of claim 10, wherein said stage includes a lower surface having a lug provided thereat, and said at least one sensor detects the position of said stage by detecting a position of said lug.

12. The device of claim 11, wherein said at least one sensor comprises a plurality of sensors, said plurality of sensors are provided along the direction of movement of said stage, and the position of said stage is determined by combining detection results from each of said sensors.

13. The device of claim 1, wherein said at least one lifting member is disposed upstream of said surface plate relative to the discharging direction.

14. The device of claim 1, wherein said printing plate includes opposite faces, one of which is an exposure surface, and said at least one discharging member holds the printing plate at a surface thereof opposite said exposure surface.

15. The device of claim 14, further comprising a guide rail disposed along the surface plate, wherein said at least one discharging member moves along said guide rail.

16. The device of claim 1, wherein said at least one lifting member is disposed at one of at least three positions with respect to the face of the surface plate, said at least three positions including a printing plate raising position higher than the face of the surface plate, a horizontal position at substantially the same height as the face of the surface plate, and a retracted position lower than the face of the surface plate.

17. The device of claim 16, wherein said at least one lifting member is configured to be separately set at all three positions.

18. A method for discharging in a discharging direction a printing plate, having a front end portion and a back end portion, from a face of a surface plate, having a front end portion and a back end portion, wherein the back end portion of the printing plate is a trailing end portion of the printing plate when the printing plate is conveyed in the discharge direction from the back end portion to the front end portion of the surface plate, comprising the steps of:

(a) raising the back end portion of the printing plate to a position higher than the face of the surface plate with a printing plate supporting portion of a lifting member;

(b) holding the raised back end portion with a discharging member; and (c) discharging the printing plate from the face of the surface plate by moving said discharging member from the back end portion of the face of the surface plate to the front end portion of the face of the surface plate, while said discharging member holds the back end portion of the printing plate.

19. The method of claim 18, wherein said step of discharging the printing plate includes moving said discharging member along the face of the surface plate while pushing the back end of the printing plate towards the front end portion of the face of the surface plate.

20. The method of claim 18, wherein the step of raising the back end portion of the printing plate includes using a cam mechanism for raising said printing plate supporting portion of said lifting member.

21. The method of claim 18, wherein the printing plate has an exposure surface and a rear surface opposite to the exposure surface, and said step of holding the raised back end portion includes holding the back end of the printing plate at the rear surface thereof.

22. A method for discharging a printing plate from a face of a surface plate, comprising the steps of:

(a) raising an end portion of the printing plate to a position higher than the face of the surface plate;

(b) engaging the end portion of the raised printing plate; and (c) pushing the end portion of the printing plate, in an engaged state, in a direction toward an opposite end portion of the printing plate, and discharging the printing plate from the surface plate.

23. A device for discharging a printing plate from a face of a surface plate having a front end portion and a back end portion, the device comprising:

(a) at least one lifting member having a printing plate supporting portion that is movable up and down relative to the face of the surface plate, said printing plate supporting portion configured to lift a back end portion of the printing plate from the face of the surface plate to the position higher than the face of the surface plate when said printing plate supporting portion moves to a position higher than the face of the surface plate;

(b) a cam mechanism provided at said at least one lifting member which moves said at least one lifting member up and down; and (c) at least one discharging member disposed along the surface plate, said at least one discharging member configured to move from the back end portion of the surface plate to the front end portion of the: surface plate while holding the back end portion of the printing plate which has been lifted by said at least one lifting member, for discharging the printing plate from the face of the surface plate; and wherein said at least one lifting member includes a back end portion, the back end portion of said at least one lifting member being rotatably supported at a pivot axis, with said printing plate supporting portion of said at least one lifting member being movable up and down with respect to the face of the surface plate by rotation about said pivot axis.

24. The device of claim 23, wherein said at least one lifting member includes a spring member provided at said back end portion of said at least one lifting member, with the spring member urging said at least one lifting member downward.

25. A device for discharging a printing plate from a face of a surface plate having a front end portion and a back end portion, the device comprising:

(a) at least one lifting member having a printing plate supporting portion that is movable up and down relative to the face of the surface plate, said printing plate supporting portion configured to lift a back end portion of the printing plate from the face of the surface plate to the position higher than the face of the surface plate when said printing plate supporting portion moves to a position higher than the face of the surface plate;

(b) a cam mechanism provided at said at least one lifting member which moves said at least one lifting member up and down; and (c) at least one discharging member disposed along the surface plate, said at least one discharging member configured to move from the back end portion of the surface plate to the front end portion of the surface plate while holding the back end portion of the printing plate which has been lifted by said at least one lifting member, for discharging the printing plate from the face of the surface plate; and wherein said at least one lifting member includes a lower surface, and the cam mechanism comprises:

(a) a discontinuous portion provided longitudinally along the lower surface of said at least one lifting member; and (b) a stage which is movable along a longitudinal direction of said at least one lifting member, and which has a roller that abuts against said lower surface of said at least one lifting member for pushing said at least one lifting member upward.

26. The device of claim 25, wherein said discontinuous portion includes a projecting portion, a recessed portion and a level portion.

27. The device of claim 26, configured such that, when said stage moves to a position such that said roller abuts against said projecting portion of said lower surface of said at least one lifting member, said at least one lifting member moves to a printing plate raising position higher than the face of the surface plate.

28. The device of claim 26, configured such that, when said stage moves to a position such that said roller abuts against said level portion of said lower surface of said at least one lifting member, said at least one lifting member moves to a horizontal position at substantially the same height as the face of the surface plate.

29. The device of claim 26, configured such that, when said stage moves to a position such that said roller abuts against said recessed portion of said lower surface of said at least one lifting member, said at least one lifting member moves to a retracted position lower than the face of the surface plate.

30. The device of claim 25, further comprising at least one sensor which detects a position along a direction of movement of said stage.

31. The device of claim 30, wherein said stage includes a lower surface having a lug provided thereat, and said at least one sensor detects the position of said stage by detecting a position of said lug.

32. The device of claim 31, wherein said at least one sensor comprises a plurality of sensors, said plurality of sensors are provided along the direction of movement of said stage, and the position of said stage is determined by combining detection results from each of said sensors.

* * * * *